US005197634A

United States Patent [19]

Beck

[11] Patent Number: 5,197,634

[45] Date of Patent: Mar. 30, 1993

[54] SIDE ORIFICE DISPENSING CLOSURE

[75] Inventor: James M. Beck, Carol Stream, Ill.

[73] Assignee: Creative Packaging Corp., Wheeling, Ill.

[21] Appl. No.: 651,320

[22] Filed: Feb. 6, 1991

Related U.S. Application Data

[60] Division of Ser. No. 442,849, Nov. 29, 1989, Pat. No. 5,016,767, which is a continuation-in-part of Ser. No. 349,158, May 9, 1989, abandoned.

[51] Int. Cl.[5] ..... B67D 5/06

[52] U.S. Cl. ..... 222/109; 222/519; 222/553; 222/549

[58] Field of Search ..... 222/519-525, 222/531, 533, 536, 537, 544-549, 553, 559, 561, 108, 109

[56] References Cited

U.S. PATENT DOCUMENTS

| | | | |
|---|---|---|---|
| 472,157 | 4/1892 | Bartlett | 222/108 |
| 2,834,520 | 5/1958 | Nyden | 222/525 |
| 3,081,921 | 3/1963 | Di Pierro et al. | 222/525 |
| 3,175,741 | 3/1965 | Porter | 222/521 |
| 3,294,294 | 12/1966 | Amburgey | 222/525 |
| 3,471,066 | 10/1969 | Micallef | 222/519 |
| 3,712,517 | 1/1973 | Davenport | 222/525 X |
| 3,777,936 | 12/1973 | Hazard | 222/525 X |
| 3,884,390 | 5/1975 | Hazard | 222/522 X |
| 3,887,116 | 6/1975 | Ishikawa et al. | 222/520 |
| 4,412,634 | 11/1983 | Bennett | 222/519 |
| 4,477,002 | 10/1984 | Stull | 222/520 X |
| 4,867,354 | 9/1989 | Schreiber | 222/521 |
| 4,878,604 | 11/1989 | Barriac | 222/209 |
| 4,979,653 | 12/1990 | Mon | 222/525 X |
| 5,052,595 | 10/1991 | Mon | 222/525 |
| 5,072,863 | 12/1991 | Stull | 222/525 X |

*Primary Examiner*—Andres Kashnikow
*Assistant Examiner*—Kenneth DeRosa
*Attorney, Agent, or Firm*—Silverman, Cass & Singer, Ltd.

[57] ABSTRACT

A dispensing closure for directing the contents out of a container including a central body portion having a top surface and a substantially cylindrical imperforate peripheral wall. The closure also includes a spout body reciprocally mounted to the body portion having an inner periphery which cooperates with the peripheral wall of the body portion to form a variable opening between the spout body inner periphery and the peripheral wall to provide a closure position and a plurality of dispensing positions for dispensing the contents of the container at a plurality of different rates as the spout body is moved on the body portion away from the closed position. The spout body is rotatable on the body portion in the closed position and the plurality of dispensing positions and includes an orifice in operable communication with said top surface for directing the contents out of the container from the top surface in a plurality of directions around the periphery of and substantially normal to the central longitudinal axis of the body portion.

1 Claim, 5 Drawing Sheets

FIG. 6
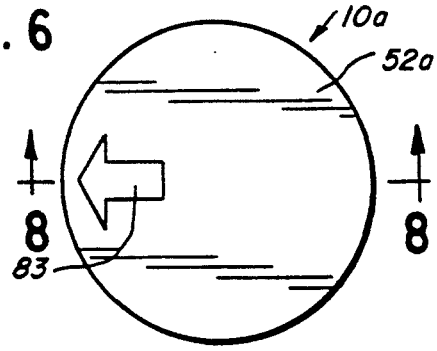
FIG. 7
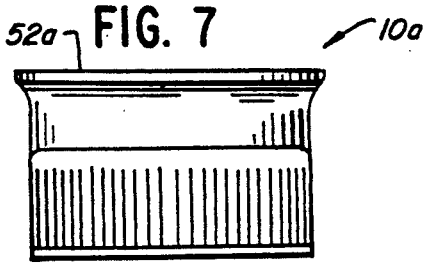
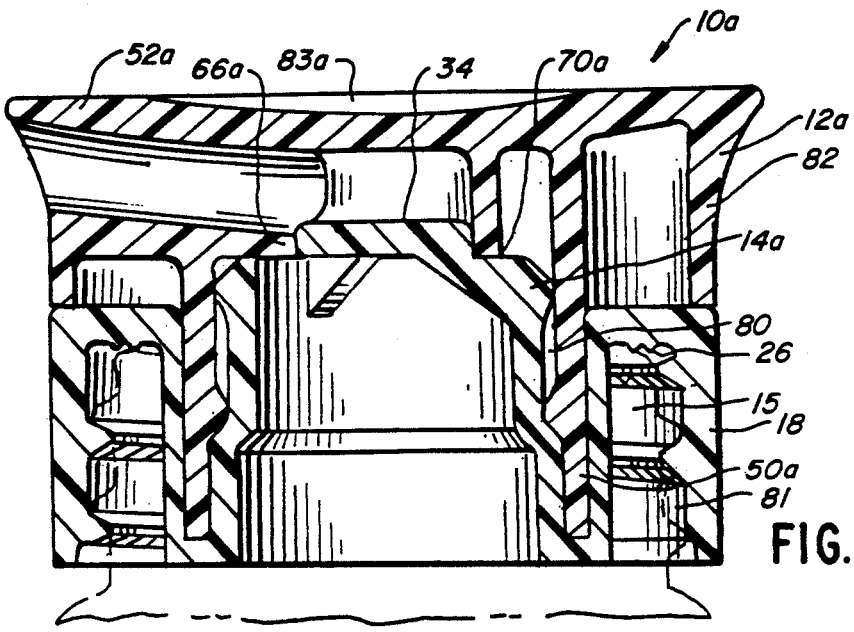
FIG. 8
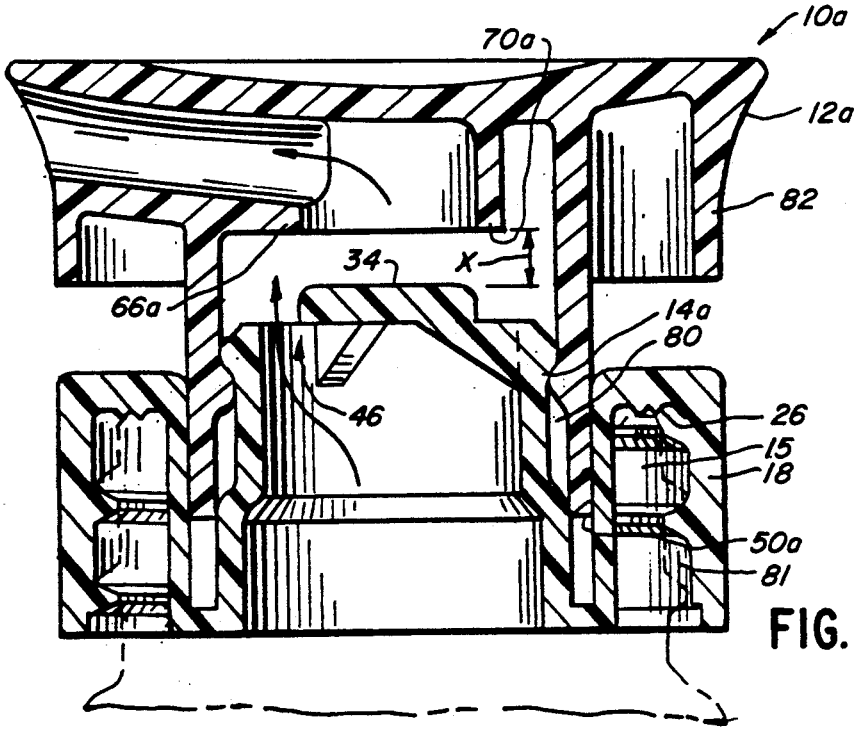
FIG. 9

SIDE ORIFICE DISPENSING CLOSURE

This is a division of application Ser. No. 07/442,849 filed Nov. 29, 1989, now U.S. Pat. No. 5,016,767, which is a continuation-in-part of application Ser. No. 07/349,158 filed on May 9, 1989 now abandoned.

BACKGROUND OF THE INVENTION

1. Field of the Invention

This invention relates generally to a dispensing closure for containers, and more particularly to a side orifice dispensing closure which has more than one dispensing position, can be rotated to dispense the contents of the container in a plurality of directions around the container, and reduces excess contents from being expelled from the closure after dispensing has ceased.

2. Description of the Prior Art

Dispensing closures for containers typically are of the push-pull or threaded screw type and generally have only two positions, either fully open or fully closed. In the fully open or dispensing position, the contents of the container can be dispensed at a fixed rate dictated by the open position structure of the closure. In the fully closed position, the contents are sealed within the container and cannot be dispensed therefrom. There are dispensing closures which have a variety of metered dispensing openings. Typically, these closures are complex in configuration, and do not lend themselves to be formed economically by molding processes, or are too fragile to be used repeatedly without failure, or both.

Examples of these existing metering closures are shown in co-pending U.S. patent application Ser. Nos. 338,482, now U. S. Pat. No. 4,927,065, filed Apr. 13, 1989 entitled "Adjustable Metering Closure Cap", and 337,752, now U.S. Pat. No. 4,967,941, filed Apr. 13, 1989 entitled "Twist Lock Adjustable Metering Closure Cap", which are hereby incorporated by reference, all of said applications being in the name of the same applicant and having the same assignee.

These existing dispensing closures typically are mounted to an opening on the top of a container and include a dispensing orifice through their top surface. Thus, the contents can be dispensed from the container in one direction only, and that direction is substantially parallel to the central axis of the opening in the container.

Furthermore, when a user is finished dispensing contents from these types of dispensing closures, a portion of the contents typically remains between the orifice and the related structure of the closure. Thus, as the closure is moved to its fully closed position, the portion of the contents between the orifice and the structure of the closure can be forced out of the orifice and usually will run down the side of the container. If the closure is moved rather quickly, the remaining contents can be forced out under pressure and squirt a significant distance from the closure and the container. This creates an undesirable condition since the expelled contents can come in contact with the user or surrounding objects which may be harmful.

It therefore is desirable to provide a dispensing closure which has more than one dispensing position, has an orifice which can dispense the contents of the container in a plurality of directions and, after dispensing has ceased, minimizes the excess amount of contents which is expelled from the closure during or after closing thereof.

SUMMARY OF THE INVENTION

The invention provides a dispensing closure for directing the contents out of a container in which the closure has a central post including a top surface and a substantially cylindrical imperforate peripheral wall with an opening to the top surface for metering the contents to be dispensed. A closure body is mounted to the central post and cooperates with the post to provide a closed position and a plurality of dispensing positions for dispensing the contents of the container at a plurality of different rates as the spout body is moved from the closure position. The spout body is rotatable in the closed position and the plurality of dispensing positions and includes an orifice in operable communication with said opening to said top surface for directing the contents out of the container from the opening to the top surface in a plurality of directions around the periphery of and substantially normal to the central longitudinal axis of the central post.

BRIEF DESCRIPTION OF THE DRAWINGS

FIG. 6 is a top plan view of an alternate embodiment of the invention;

FIG. 7 is a rear elevational view of the closure shown in FIG. 6;

FIG. 8 is a longitudinal cross-sectional view of the embodiment shown in FIG. 6 and illustrating the closure in its closed position;

FIG. 9 is a view similar to FIG. 8 but showing the closure in its open position;

DESCRIPTION OF THE PREFERRED EMBODIMENTS

Figure 1:
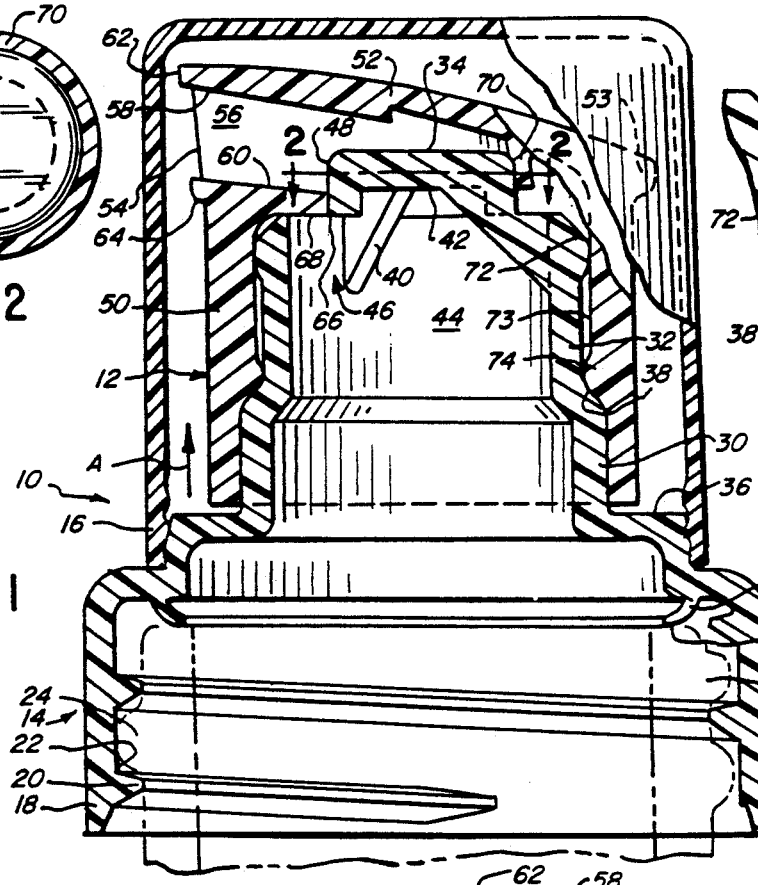
FIG. 1 is a longitudinal cross-sectional view of one embodiment of the dispensing closure of the invention illustrated in its fully closed position.
Figure 4:
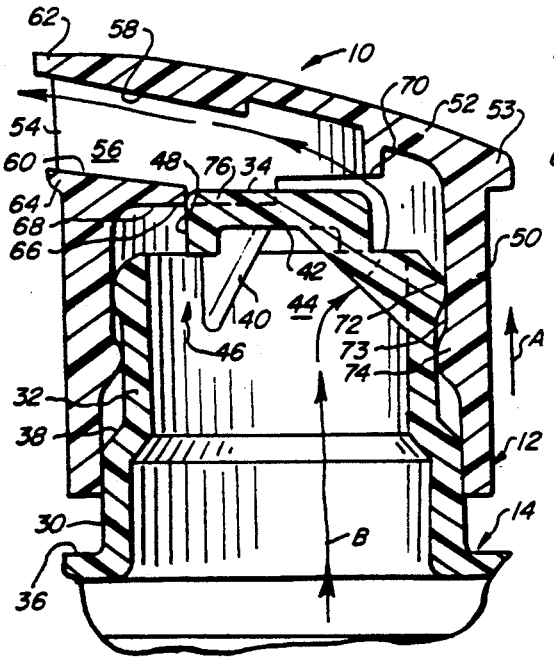
FIG. 4 is a longitudinal cross-sectional view of the dispensing closure shown in to FIG. 1 and illustrating the dispensing closure in an intermediate dispensing position.
Figure 5:
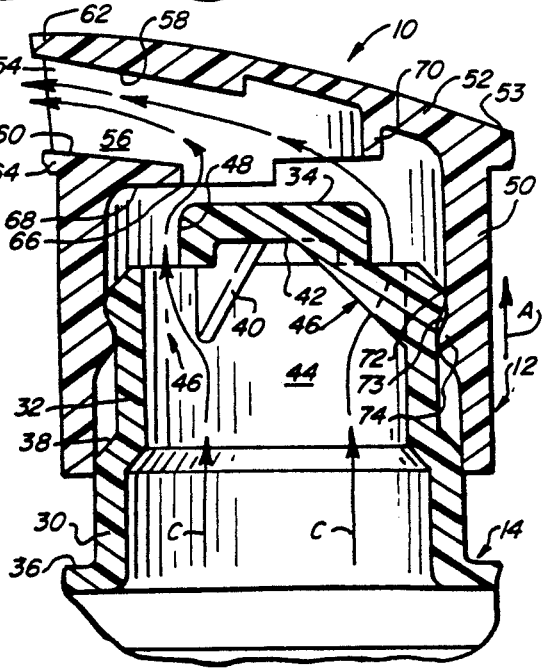
FIG. 5 is a longitudinal cross-sectional view of the dispensing closure shown in FIGS. 1 and 4 illustrating the dispensing closure in its fully open position.
Figure 10:
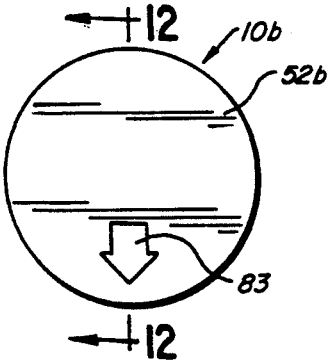
FIG. 10 is a top plan view of another embodiment of the invention.
Figure 11:
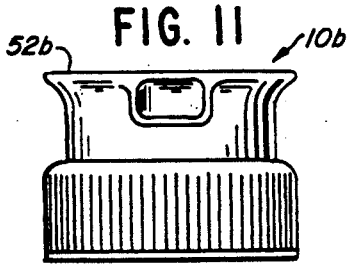
FIG. 11 is a front elevational view of the closure shown in FIG. 10.

Referring to FIGS. 1, 4, and 5, a first embodiment of the dispensing closure of the invention is designated generally by the reference numeral 10. The closure 10 is generally cylindrical in cross-sectional configuration and includes an outer closure body 12 and an inner metering post or stem 14. A protective cover 16 also can be included which surrounds the body 12 and can be threadingly engaged to the stem 14 to protect the closure 10 when not in use.

The post 14 includes a cylindrical bottom skirt 18 which typically is secured to a neck 15 of a container illustrated in dotted outline in FIG. 1. The container can be any type of container which will accept the closure 10 and is not illustrated in any of the figures.

Preferably, the closure 10 is formed of plastic material which readily can be molded in an injection type molding process. The construction, material and molding process of the closure 10, however, can vary.

Briefly, in operation, the body 12 moves along a portion of the length of the post 14 from a fully closed or closure position, illustrated in FIG. 1, through a plurality of intermediate dispensing positions, one of which is illustrated in FIG. 4, to a fully open position illustrated in FIG. 5. When the body 12 is in the fully closed position or any of the dispensing positions, the body 12 can be rotated around the entire circumference of the post 14. Additionally, as FIGS. 4 and 5 illustrate, when the body 12 is in any of its dispensing positions, any of the contents remaining within the body 12 after a user has completed dispensing can be returned to the container such as by gravity. Furthermore, a channel is provided within the body 12 to accommodate any excess portion of the contents which does not flow back into the container before fully closing the closure 10.

Thus, when the closure 10 is positioned in any of its dispensing positions, the body 12 can be rotated and the contents can be dispensed in a plurality of directions around the circumference of and substantially normal to the post 14. The body 12 can also be pre-positioned when in its fully closed position to direct the contents out of the closure 10 in a desired direction before dispensing. Furthermore, excess contents remaining in the body 12 will not be forced out of the closure 10 upon movement of the closure 10 to its fully closed position and can be returned to the container when the closure 10 is in any of its dispensing positions. The operation of the body 12, post 14 and channel will be described in detail hereinafter.

Preferably, the body 12 is mounted to the post 14 for a push-pull type of operation. It is to be understood, however, that the body 12 can be threadingly mounted to the post 14 for a rotational screw or twist type operation or a combination of push-pull and screw type operation without departing from the teachings of the present invention.

As FIG. 1 illustrates, in order to threadingly engage the closure 10 to the neck 15 of the container, the skirt 18 of the post 14 includes a plurality of threads 20 formed on an interior surface 22 of the bottom skirt 18. The threads 20 mate with corresponding threads 24 on the neck 15 of the container which are illustrated in dotted outline.

In order to seal the post 14 to the neck 15 of the container, an annular seal ring 26 is integrally formed with the interior surface 22 near the top of the bottom skirt 18. The seal ring 26 mates with a top surface 28 of the neck 15 when the post 14 is threaded onto the neck 15 and prevents any of the contents from leaking between the post 14 and the neck 15.

The post 14 includes first, second, and third substantially cylindrical imperforate peripheral wall portions 30, 32, and 34. A first peripheral shoulder portion 36 is provided to connect the bottom skirt 18 to the first wall portion 30 as well as a second peripheral shoulder portion 38 to connect the first and second wall portions 30 and 32.

Preferably, the outside diameters of the bottom skirt 18 and the first, second, and third wall portions 30, 32, and 34 respectively, become progressively smaller. Thus, the post 14 becomes progressively narrower as the post 14 extends from the bottom skirt 18 to the third wall portion 34.

As FIGS. 1, 4, and 5 illustrate, in order to connect the third wall portion 34 to the second wall portion 32, the third wall portion 34 includes a plurality of depending legs 40. The legs 40 are connected at one end to a bottom surface 42 of the third wall portion 34 and at the opposite end to an interior surface 44 of the second wall portion 32.

In order to enable the contents to flow out of the container and through the post 14, the legs 40 are positioned on the bottom surface 42 of the third wall portion 34 and are staggered around the periphery of the interior surface 44 of the second wall portion 32 to form a spider. Thus, the third wall portion 34 is suspended within the interior of the second wall portion 32 so that a plurality of apertures or through passages 46 are formed between the legs 40, the interior surface 44 of the second wall portion 32, and an exterior surface 48 of the third wall portion 34.

As FIG. 1 illustrates, the body 12 includes a substantially cylindrical imperforate peripheral wall portion 50 and a substantially circular top portion 52. In order to assist a user in gripping the body 12, an annular engagement lip or shoulder 53 can be included around the top of the wall portion 50. Preferably, the top portion 52 is integrally formed with the wall portion 50 and is sloped upward at a slight angle with respect to a horizontal plane normal to the central longitudinal axis of the wall portion 50.

In order to dispense the contents out of the body 12, a dispensing orifice 54 and a channel 56 are provided in the wall portion 50 proximate the top portion 52 on the elevated or high side of the top portion 52. The channel 56 extends from the orifice 54 into the interior of the body 12 to a position near the opposite side of the body 12. Preferably, the orifice 54 and the channel 56 are rectangular in cross-section, but can be circular, oval, or any other desired cross-sectional configuration.

The channel 56 includes a top wall 58 and a bottom wall 60, both of which preferably are sloped downwardly. The side walls of the channel 56 can be formed by an extension of an engagement member which will be described in detail hereinafter. In order to inhibit dust, dirt, or other foreign matter from entering the orifice 54 and channel 56, the top wall 58 and bottom wall 60 protrude slightly outwardly away from the orifice 54 and wall portion 50 to form top and bottom lips 62 and 64 respectively. Preferably, the top lip 62 protrudes further outward than the bottom lip 64 to further assist in inhibiting foreign matter from entering the orifice 54 and the channel 56. Additionally, since the top portion 52 is sloped downwardly away from the orifice 54, foreign matter does not tend to accumulate on the top surface 52 and is directed away from the orifice 54.

The bottom wall 60 extends only a short distance into the interior of the body 12 and terminates at a distal end 66 which is undercut or relieved at 68. Thus, the distal end 66 forms an engagement member for operable communication with one portion or side of the exterior surface 48 of the third wall portion 34. This operable communication assists in providing the plurality of dispensing positions as will be described hereinafter. To provide good contact between the distal end 66 and the exterior surface 48, the distal end 66 is semi-circular in cross sectional configuration and has a circumference which is of substantially the same dimension as that of the outer circumference of the exterior surface 48 of the third wall portion 34.

Figure 2:
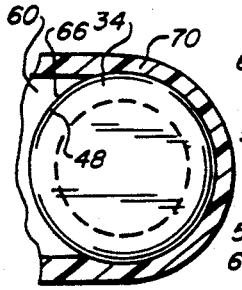
FIG. 2 is a sectional view taken along the line 2—2 of FIG. 1 in the direction indicated generally, illustrating the seal around the central post.

The top wall 58 extends from the orifice 54 substantially across the interior of the body 12 to a position proximate the opposite side of the wall portion 50. The top wall 58 includes a depending semi-circular engagement flange member 70. As FIGS. 1 and 2 illustrate, when the closure 10 is in the fully closed position of FIG. 1, the flange 70 cooperates with the distal end 66 of the bottom wall 60 to completely encircle and form a seal around the exterior surface 48 of the third wall portion 34. Thus, the contents of the container are prevented from entering the channel 56 from the through passages 46 between the second and third wall portions 32 and 34 and cannot exit the orifice 54.

As described briefly above, the side walls of the channel 56 can be formed by an extension of the engagement flange 70. Thus, the engagement flange 70 is formed as a loop which extends from the orifice 54 into the body 12 so that it can surround the second wall portion 34 of the post 14 when the closure 10 is in the fully closed position. Alternatively, the side walls of the channel 56 can be formed by separate members.

Figure 3:
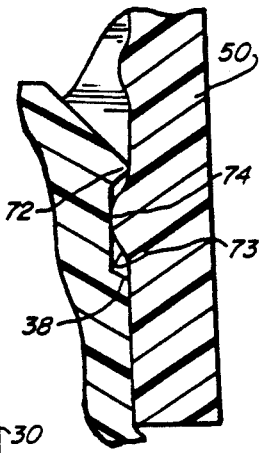
FIG. 3 is an enlarged view of a portion of the dispensing closure of FIG. 1 illustrating the cooperation between the central post member and the closure body.

As FIGS. 1 and 3 illustrate, to assist in preventing the contents of the container from leaking down onto the exterior surfaces of the first and second wall portions 30 and 32 of the post 14, the second wall portion 32 can include an annular shoulder portion or ring 72 which protrudes slightly outward from the top of the second wall portion 32. The ring 72 bears against an interior surface 73 of the wall portion 50 of the body 12 and forms a seal therebetween.

In order to restrict longitudinal movement of the body 12 on the post 14, the interior surface 73 of the body 12 includes an annular shoulder portion or ring 74. As the body 12 is moved on the post 14, the ring 74 rides along the exterior surface of the second wall portion 32 between the ring 72 and the shoulder 38 between the first and second wall portions 30 and 32. To form the closed position and provide a positive indication to the user that the spout is in the closed position, the ring 74 contacts the shoulder 38 which is formed between the first and second wall portions 30 and 32 of the post 14. Similarly, to form the fully open position, the ring 74 contacts the ring 72 of the second wall portion 32.

Accordingly, the cap body 12 is movable on the post 14 between its fully closed position and its fully open position and is inhibited from being removed from the post 14 by the abutment of the ring 74 and the ring 72. If the body 12, however, is pulled upwardly away from the post 14 with extreme force, the ring 74 can disengage from the ring 72 to separate the body 12 from the post 14. The ring 74 also serves as a secondary seal to prevent the contents from leaking down onto the first wall portion 30 similar to the operation of the ring 72.

The operation of the closure 10 will now be described in detail beginning with the closure 10 in its fully closed position as illustrated in FIG. 1. In this position, the distal end 66 of the bottom wall 60 and the flange 70 of the channel 56 completely surround and form a seal with the exterior surface 48 of the third wall portion 34. The through apertures 46 are thereby sealed to prevent the contents from exiting the container.

It is to be noted that even in this fully closed position the body 12 can be rotated about the post 14 without breaking the seal around the third wall portion 34. This enables a user to pre-position the body 12 and the orifice 54 before dispensing so that the contents can be dispensed in a desired direction.

As FIG. 4 illustrates, upon an upward pull of the body 12 in the direction of arrow "A", the flange 70 disengages from a substantial peripheral portion of the exterior surface 48 of the third wall portion 34 while the distal end 66 still remains in contact with a portion of the exterior surface 48 of the third wall portion 34. The body 12 is thereby positioned in one of its intermediate dispensing positions. In this intermediate dispensing position, a substantial portion of the exterior surface 48 of the third wall portion 34, corresponding to the engagement area of the flange 70, is no longer sealed. This permits the contents to flow along the path designated by arrow "B" from the container, through the neck 15, the first and second wall portions 30 and 32, the through apertures 46, between the exterior surface 48 of the third wall portion 34 and the flange 70, through the channel 56 and out of the orifice 54. It is to be noted that the flow path designated by arrow "B" extends around the exterior surface 48 of the third wall portion 34 except for the portion of the exterior surface 48 still in contact with the distal end 66.

As the body 12 is pulled further upward, the gap between the third wall portion 34 and the flange 70 increases, thereby providing an increased flow rate. To further increase the flow rate, the body 12 can be pulled further upward so that the distal end 66 of the bottom wall 60 of the channel 56 disengages from the exterior surface 48 of the third wall portion 34. Thus, the contents can flow around the entire periphery of the third wall portion 34 along the paths designated by arrows "C" of FIG. 5.

The body 12 can be pulled upward until it reaches the fully open position of FIG. 5. In this position the maximum clearance is achieved between the third wall portion 34 and both the distal end 66 and the flange 70 of the channel 56 to provide the maximum flow rate of the closure 10. It is to be noted that in any of the dispensing positions the body 12 can be rotated around the post 14 to enable a user to direct the contents out of the orifice 54 in a desired direction.

Typically, when dispensing is finished, contents remain within the channel 56, between the channel 56 and the third wall portion 34 as well as between the third wall portion 34 and the body 12. As described above, the channel 56 is sloped downwardly toward the third wall portion 34. As FIGS. 4 and 5 illustrate, when the closure 10 is in any of its dispensing positions and the container is placed in a substantially upright position, the downward slope of the channel 56 enables the excess contents to be returned to the container after dispensing through the apertures 46, some of which are still open, depending upon the position of the distal end 66 of the bottom wall 60 of the channel 56.

Additionally, as the body 12 is moved from its fully open position of FIG. 5 toward its fully closed position of FIG. 1, the excess contents between the third wall portion 34 and the body 12 can be forced downward by the body 12 back through the apertures 46 and into the container. This helps reduce or eliminate any excess contents from remaining within the channel 56 after fully closing the closure 10.

Furthermore, if any of the contents remaining within the channel 56 do not return to the container before the closure 10 reaches its fully closed position of FIG. 1, the remaining contents can remain within the channel 56. Typically, prior art closures do not provide such a channel which acts as a holding area for these excess contents. Thus, when the closure is returned to the fully closed position in these prior art closures, the excess contents are forced out of the orifice causing the undesirable condition described above. In fact, if the prior art closures are closed rapidly, the contents can squirt out a slight distance from the orifice 54.

FIG. 4 illustrates a modification of the third wall portion 34 of the closure 10 wherein common elements are referred to by the same numerals. In order to further control and meter the flow of the contents out of the closure 10, the top of the third wall portion 34 can include one or more slots 76 of the same or variable lengths and depths. Thus, in order to establish the fully closed position, the flange 70 and the distal end 66 of the channel 56 must engage the exterior wall 48 of the third wall portion 34 below the slots 76. In order to establish an initial reduced flow rate, the flange 70 and the distal end 66 of the channel 56 must extend slightly above the bottom surface of the slots 76 as FIG. 4 illustrates. Thereafter, the closure 10 operates as described above.

FIGS. 6–9 illustrate an alternate embodiment of the invention in which common elements are referred to by the same reference numerals. In this embodiment, the closure **10*a* is designed to have a shorter vertical profile than the closure 10** of the previous embodiments.

As FIGS. 8 and 9 illustrate, the metering post or stem **14*a* is recessed so that it is positioned within the circumferential confines of the bottom skirt 18. Thus, a circumferential groove 80 is formed in the closure 10*a* which accepts a modified peripheral wall portion 50*a* of the body 12*a***.

Similarly, a circumferential groove 81 is formed to accommodate the threaded neck 15 of the container. It is to be noted that the cooperation between the groove 81 and the threaded neck 15 provides an extended flow path for material to pass between the neck 15 and the body **12*a* which, combined with the annular seal ring 26**, reduces leakage.

In order to provide a smooth transition between the body **12*a* and the skirt 18 when the closure 10*a* is in its closed position shown in FIG. 8, the body 12*a* includes an outer circumferential peripheral wall 82 which mates with the first shoulder portion 36*a* of the skirt 18**.

The variable dispensing feature of the closure **10*a* is provided by the amount of vertical distance between the third wall portion 34 and the engagement members 66*a* and 70*a* of the body 12*a*. As FIG. 9 illustrates, when the body 12*a* is in its fully open position a maximum distance "X" is achieved between the third wall portion 34 and the engagement members 66*a* and 70*a*** thereby permitting maximum flow of contents out of the container. Thus, intermediate dispensing positions are provided as the distance "X" decreases.

As in the embodiments of FIGS. 1–6, the engagement member or flange **70*a* can be reduced in length (not illustrated) with respect to the engagement member 66*a* to assist in variable dispensing. Also, to further control and meter the flow of contents, slots (not illustrated) can be formed in the third wall portion 34*a***.

As FIG. 6 illustrates, the top portion **52*a* can include a flow direction arrow 83 indicating the radial position of the orifice 54. Additionally, as FIGS. 7–9 illustrate, the exterior surface of the top portion 52*a* can include a concave portion 83*a* while the edges of the top portion remain substantially perpendicular with respect to the central longitudinal axis of the closure 10*a***.

The remaining elements as well as the operation of the closure **10*a* are substantially the same as that of the closure 10** of the previous embodiments.

FIGS. 10–14 illustrate an alternate embodiment of the invention in which common elements are referred to by the same reference numerals. In this embodiment, as in the embodiment of FIGS. 6–9, the closure **10*b* is designed to have a shorter vertical profile than the closure 10** of the previous embodiments.

Figure 12:
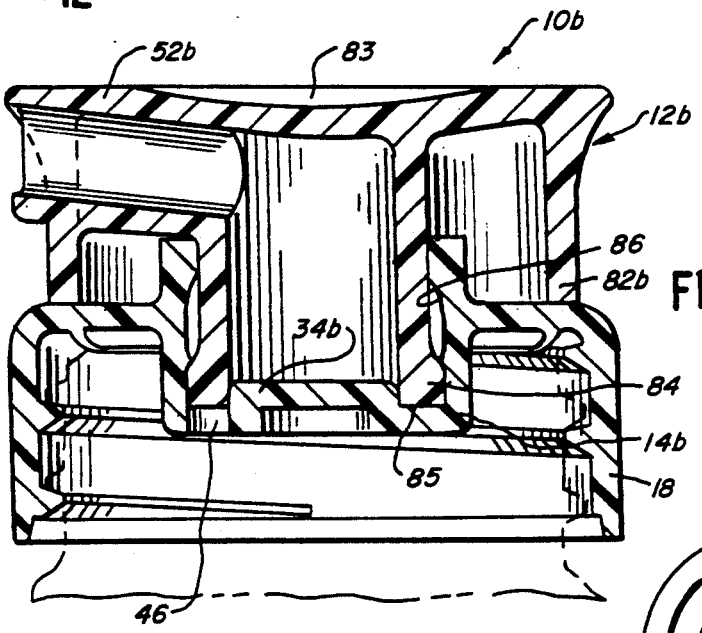
FIG. 12 is a longitudinal cross-sectional view of the embodiment shown in FIG. 10 and illustrating the closure in its closed position.
Figure 14:
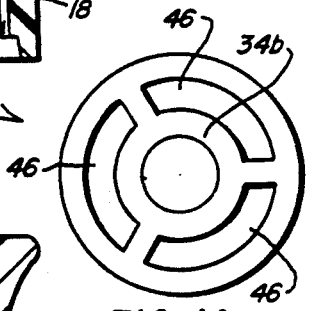
FIG. 14 is a sectional view taken along the line 14—14 of FIG. 13 in the direction indicated generally, illustrating the flow openings in the central post member.
Figure 13:
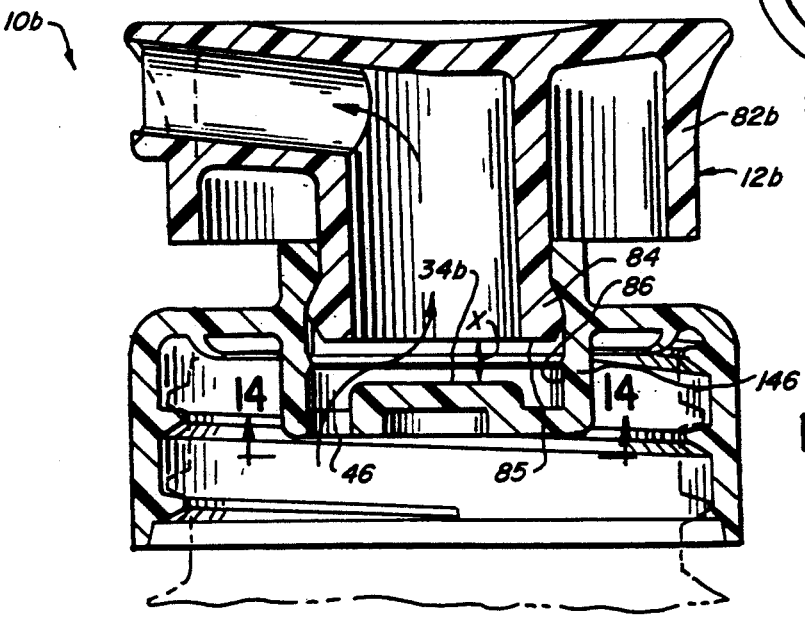
FIG. 13 is a view similar to FIG. 12 but showing the closure in its open position.
Figure 15:
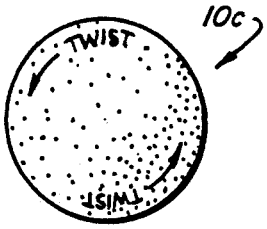
FIG. 15 is a top plan view of another embodiment of the invention.
Figure 16:
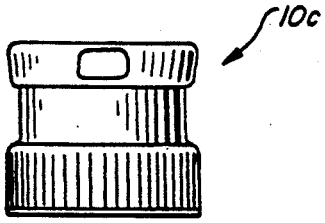
FIG. 16 is a front elevational view of the closure shown in FIG. 15.

As FIGS. 12 and 13 illustrate, the metering post or stem 14 is substantially eliminated and replaced with a recessed portion **14*b*. The third wall portion 34*b*, including the spider and flow apertures 46, is positioned at the bottom of the recessed portion 14*b*. The body 12*b* thus is designed to seat within the recessed portion 14*b* rather than being reciprocally mounted on the post 14** as in the previous embodiments.

In order to retain the body **12*b* within the recessed portion 14*b*, the body 12*b* includes an outwardly extending peripheral flange 84 proximate its bottom surface. The flange 84 abuts a circumferential side wall 86 forming the recessed portion 14*b*. As the body 12*b* is moved toward its open position shown in FIG. 13, the flange 84 of the body 12*b* moves along the side wall 86 of the recess 14*b* until it engages with an inwardly bowed portion of the side wall 86 proximate the top of the recessed portion 14*b* thereby retaining the body 12*b* therein. It is to be noted, however, that an excessive upward axial force will enable the body 12*b* to be removed from within the recessed portion 14*b***.

In this embodiment, the fully closed position is established by the engagement of the bottom portion 85 of the body **12*b* with the third wall portion 34*b* thereby sealing off the apertures 46. As with the embodiment of FIGS. 6–9, intermediate flow positions are achieved in this embodiment as the body 12*b* is moved away from the third wall portion 34*b* from its closed position shown in FIG. 12 to its fully open position shown in FIG. 13 where the maximum distance "X" between the body 12*b* and the third wall portion 34*b*** is achieved.

Additionally, a portion of the bottom 85 of the body **12*b* can be formed with one or more depending wall members (not illustrated) which extend downward and slightly through the apertures 46 as the body 12b is moved toward its closed position. These depending wall members would restrict the flow of material through one or more of the apertures 46 to provide the restrricted flow. When the body 12b is positioned in its fully open position, the wall members would be positioned above the third wall portion 34b and would not restrict flow through the apertures 46. Also, slots (not illustrated) can be provided in the third wall portion 34b** to further meter the flow of contents.

As in the embodiment of FIGS. 6–9, the body 12b can include an outer circumferential wall 82b to provide a smooth transition between the body 12b and the skirt 18. Also, the top portion 52b can include the flow direction arrow 83 and the convcave portion 83a. The remaining elements and operation of the closure 10b are similar to that of the closures 10 and 10a of the previous embodiments.

FIGS. 15–18 illustrate another embodiment of the invention in which common elements are referred to by the same reference numerals. In this embodiment, the closure 10c is similar to the closure 10b of the embodiment of FIGS. 10–14 since the body portion 12c is positioned within a recessed portion 14c.

In the embodiment of FIGS. 15–18, however, the body portion 12c is threadingly mounted for a rotational screw or twist type operation rather than just a push-pull type of operation. Thus, the skirt 18 is formed with an upwardly extending circumferential wall member 88 having threads 90 on its interior surface. The threads 90 mate with corresponding threads 92 formed on the exterior surface of the wall 82c of the body portion 12c.

Figure 17:
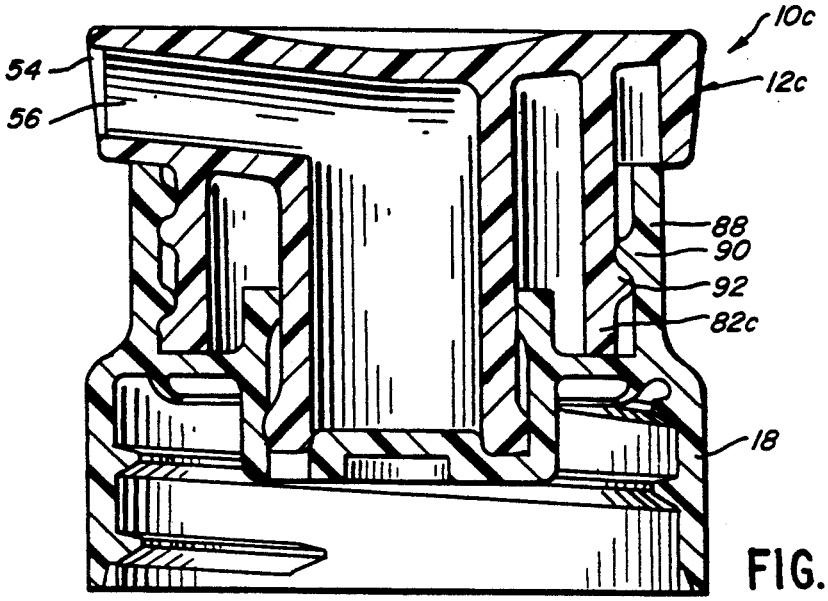
FIG. 17 is a longitudinal cross-sectional view of the embodiment shown in FIG. 15 and illustrating the closure in its closed position.
Figure 18:
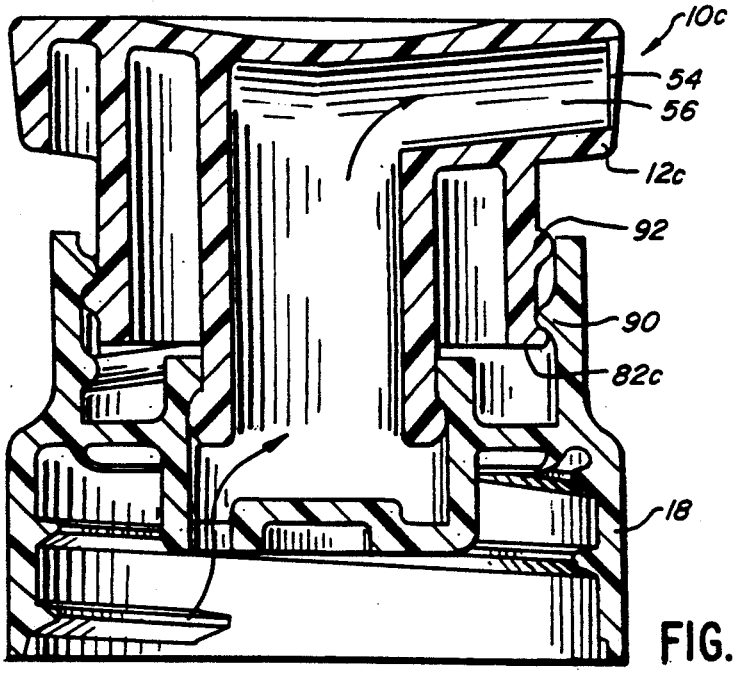
FIG. 18 is a view similar to FIG. 17 but showing the closure on its open position.
Figure 19:
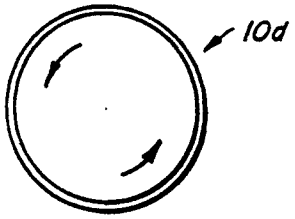
FIG. 19 is a top plan view of another embodiment of the invention.
Figure 20:
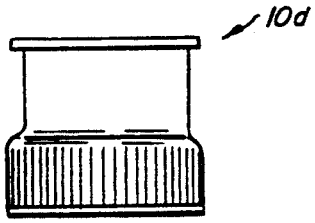
FIG. 20 is a front elevational view of the closure shown in FIG. 19.

Accordingly, the radial direction of the orifice 54 and the channel 56 changes as the body 12c is rotated between its closed and open positions shown in FIGS. 17 and 18 respectively. Also, the threads 90 and 92 can be designed so that the body 12c can be rotated to any direction with respect to the recessed portion 14c when the closure 10c is either in its fully open or fully closed position. The remaining elements and operation of the closure 10c are substantially the same as those of the closure 10b of the previous embodiment.

FIGS. 19–22 illustrate another embodiment of the invention in which common elements are referred to by the same reference numerals. In this embodiment, the closure 10d is similar to the threaded closure 10c of the embodiment of FIGS. 15–18.

Figure 21:
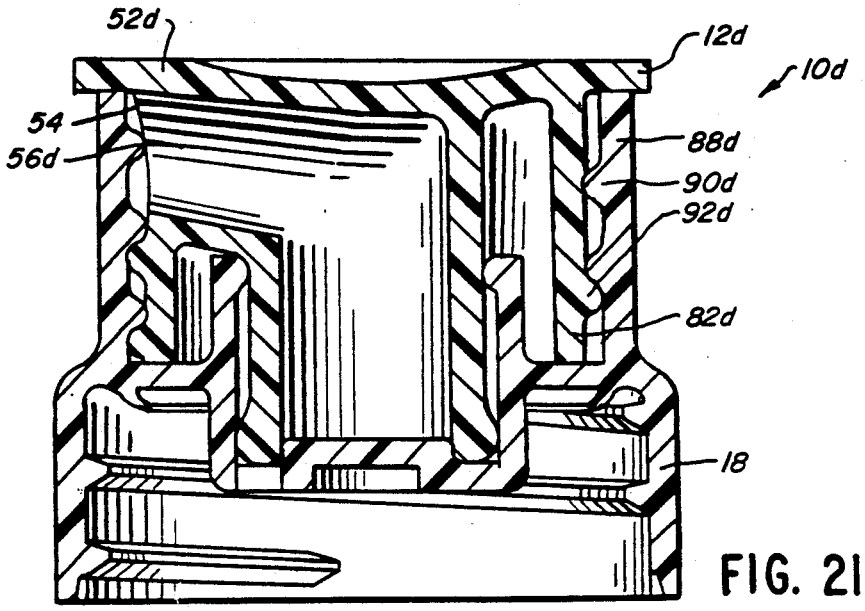
FIG. 21 is a longitudinal cross-sectional view of the embodiment shown in FIG. 19 and illustrating the closure in its closed position.
Figure 22:
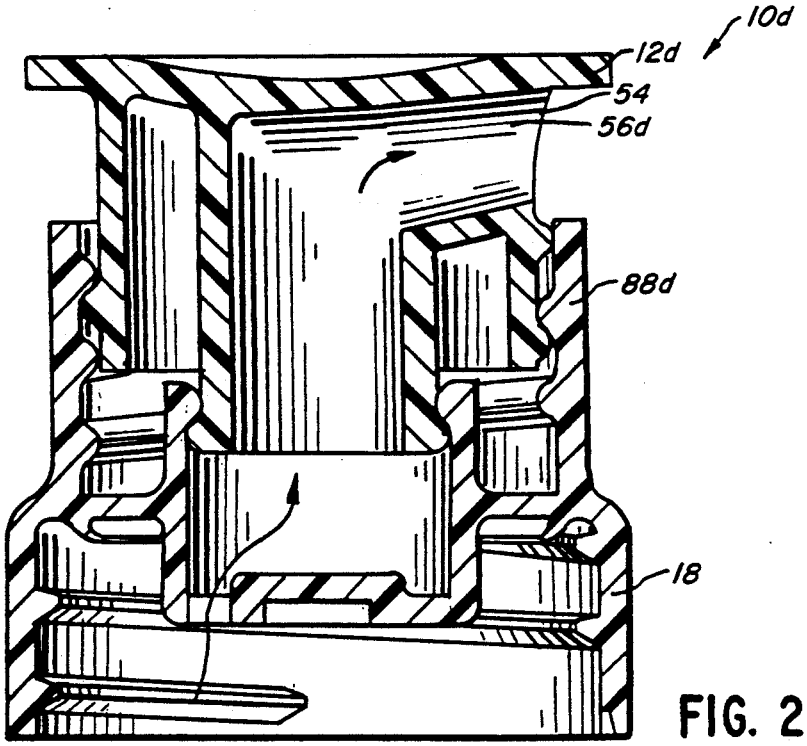
FIG. 22 is a view similar to FIG. 21 but showing the closure in its open position.

In the embodiment of FIGS. 19–22, however, the closure 10d is designed so that the orifice 54 is closed or blocked off by wall member 88d when the closure 10d is in the fully closed position as illustrated in FIG. 21. Accordingly, the channel 56d is reduced in length so that it is contained beneath the top portion 52d of the body 12d.

Also, the wall member 88d on the skirt 18 is slightly taller than the wall member 88 of the embodiment of FIGS. 15–18 to provide the desired blocking of the orifice 54. The remaining elements and operation of the closure 10d are substantially the same as those of the closure 10c of previous embodiment.

Modifications and variations of the present invention are possible in light of the above teachings. A specific dimension, material, or construction is not required so long as the assembled device is able to function as herein described. It is therefore to be understood that within the scope of the appended claims, the invention may be practiced otherwise than as specifically described.

What is claimed and desired to be secured by letters patent of the United States is:

1. A dispensing closure for directing the contents out of a container comprising:

a body portion having a cylindrical recess, said recess being defined by a bottom surface and a substantially cylindrical imperforate peripheral wall upstanding from said bottom surface and with an opening to said bottom surface for metering the contents to be dispensed;

a spout body mounted within said recess and having an outer periphery, said spout body cooperating with said bottom surface and said outer periphery engaging said peripheral wall of said recess to form a variable opening between said spout body and said body portion to provide a closed position and a plurality of dispensing positions for dispensing the contents of said container at a plurality of different rates as said spout body is moved in said recess away from said closed position, said spout body including an orifice in operable communication with said opening to said bottom surface for directing the contents out of the container in a plurality of directions around the periphery of and substantially normal to the central longitudinal axis of said recess; and said spout body being mounted within said recess by threads and upon rotation between said spout body and said recess said spout body is moved between said closed position through a plurality of dispensing positions to a fully open position where said spout body is rotatable in said recess in said closed position and said fully open position for directing the contents out of said orifice in said plurality of directions.

* * * * *

UNITED STATES PATENT AND TRADEMARK OFFICE

CERTIFICATE OF CORRECTION

PATENT NO. : 5,197,634

DATED : March 30, 1993

INVENTOR(S) : James M. Beck

It is certified that error appears in the above-identified patent and that said Letters Patent is hereby corrected as shown below:

Title page and Column 1, line 3, Pat. No. "5,016,767" should be --5,016,787--;

Column 9, line 5, "restrricted" should be --restricted--.

Signed and Sealed this

Thirtieth Day of November, 1993

*Attest:*

*Attesting Officer*

BRUCE LEHMAN

*Commissioner of Patents and Trademarks*